United States Patent [19]

Morifuji et al.

[11] Patent Number: 4,993,568

[45] Date of Patent: Feb. 19, 1991

[54] NIPPLE FOR NURSING BOTTLES

[75] Inventors: Yasuo Morifuji; Yoshifumi Takao, both of Osaka, Japan

[73] Assignee: JEX Co., Ltd., Osaka, Japan

[21] Appl. No.: 412,363

[22] Filed: Sep. 26, 1989

[30] Foreign Application Priority Data

Dec. 15, 1988 [JP] Japan ..... 63-318188

[51] Int. Cl.[5] ..... A61J 11/00; A61J 11/02

[52] U.S. Cl. ..... 215/11.1; 215/11.4; 215/11.5

[58] Field of Search ..... 215/11.1, 11.4, 11.5, 215/11.3, 11.6

[56] References Cited

U.S. PATENT DOCUMENTS

| | | | |
|---|---|---|---|
| 981,072 | 1/1911 | Decker | 215/11.1 |
| 1,146,639 | 7/1915 | Miller | 215/11.5 |
| 1,972,895 | 9/1934 | MacCoy | 215/11.5 |
| 2,174,361 | 9/1939 | Condon | 215/11.5 |
| 2,223,179 | 11/1940 | Lougheed | 215/11.1 |
| 2,442,656 | 6/1948 | Less | 215/11.4 |
| 2,486,364 | 10/1949 | Simmons | 215/11.1 X |
| 2,584,359 | 2/1952 | Miles | 215/11.4 |
| 2,630,118 | 3/1953 | Casey | 215/11.4 |
| 2,688,326 | 9/1954 | Lerman | 215/11.5 X |
| 2,708,421 | 5/1955 | Jauch | 215/11.4 X |
| 2,733,843 | 2/1956 | Seroko | 215/11.1 X |
| 2,774,500 | 12/1956 | Budiani | 215/11.1 |
| 2,803,251 | 8/1957 | White | 215/11.4 |
| 2,960,088 | 11/1960 | Witz | 215/11.4 |
| 3,424,157 | 1/1969 | Dipaolo | 215/11.4 |
| 3,704,803 | 12/1972 | Ponder | 215/11.5 X |
| 3,718,140 | 2/1973 | Yamaucht | 215/11.1 |

FOREIGN PATENT DOCUMENTS

| | | | |
|---|---|---|---|
| 63500 | 7/1892 | Fed. Rep. of Germany | 215/11.1 |
| 199285 | 6/1923 | United Kingdom | 215/11.5 |
| 1432798 | 4/1976 | United Kingdom | 215/11.5 |
| 2169210 | 7/1986 | United Kingdom | 215/11.4 |

*Primary Examiner*—Sue A. Weaver

*Attorney, Agent, or Firm*—Armstrong, Nikaido, Marmelstein, Kubovcik & Murray

[57] ABSTRACT

A nipple (3) for a nursing bottle (1) is made from a soft elastic material, such as plastic. The nipple comprises a front end portion (7) serving as a mouthpiece, a bottle mouth fitting portion (9) to be removably fitted to the opening (5) in the bottle body (2) by a clamping ring (4), and an inverted funnel-shaped intermediate portion (8) disposed intermediate between these portions. A partition wall (11) having a milk sucking hole (12) is integrally formed in the interior.

7 Claims, 3 Drawing Sheets

FIG. 1
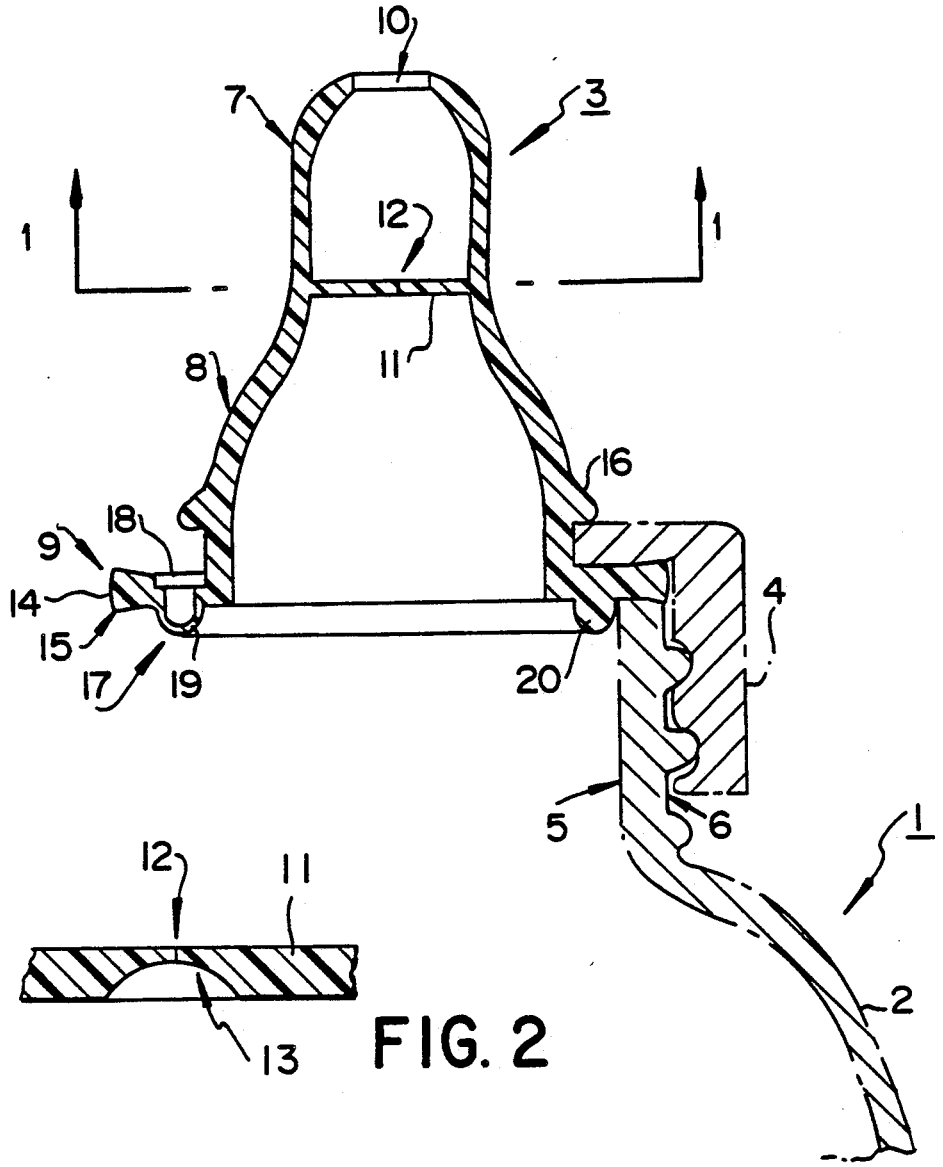
FIG. 2
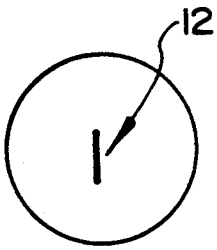
FIG. 1a
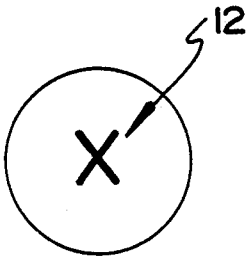
FIG. 1b
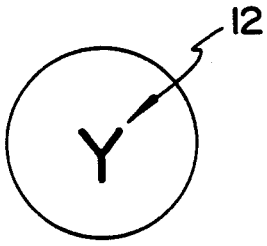
FIG. 1c

NIPPLE FOR NURSING BOTTLES

BACKGROUND OF THE INVENTION

The present invention relates to a nipple for nursing bottles.

A conventional nipple for nursing bottles which is now in wide use is formed of a soft material (natural rubber, plastic or the like) shaped like a mother's nipple, with a milk sucking hole formed in the front end of the nipple (see, for example, Japanese Patent Publication No. 38265/1976 and Japanese Utility Model Publication No. 27462/1982).

Such conventional nipple for nursing bottles having a milk sucking hole formed in the front end thereof enables a baby to suck milk from the nursing bottle by simply sucking at the front end portion of the nipple. On the other hand, in sucking mother's milk directly from his mother, a baby puts not only the mother's nipple but also the areola in his mouth and, while moving his upper and lower jaws for mastication, uses his tongue tip to apply pressure to an area extending from the areola to the nipple to squeeze the area for drawing milk. That is, in the case where a mother suckles her baby, the baby could not sufficiently draw milk liquid (mother's milk) by simply sucking at the front end portion of the mother's nipple (the nipple tip).

Recently, the value of feeding a baby on mother's milk has been appreciated anew; however, for some days immediately after childbirth, the breast yields no milk and hence artificial milk is given to the baby through a nursing bottle. And also in other cases where mother's milk is insufficient in amount, reliance has to be placed on artificial milk. In such cases, giving a baby milk through a nursing bottle does not involve so much need for the complicated combined movement comprising masticatory movement of the upper and lower jaws and squeezing movement of the tongue tip as does suckling a baby. For this reason, the baby tends to stop making efforts to suck, and it has been pointed out that this tendency is liable to prevent smooth shift to breast-feeding. And it is also reported that forcing babies to practice said complicated combined movement comprising masticatory and squeezing movements naturally contributes to sound development of the cerebrum.

SUMMARY OF THE INVENTION

The present invention has been accomplished with the above in mind and has for its object the provision of a nipple for nursing bottles which enables babies to get accustomed to making a sucking effort which approximates to that involved in breast-feeding.

To solve such problem, according to the invention, a nipple having an opening in the front end thereof is provided with a partition diaphragm disposed in a region remote from the front end and a milk sucking hole is formed in said partition diaphragm.

The milk sucking hole is adapted to open when the partition diaphragm is pressed and to close when it is released from the pressure. Since the partition diaphragm is located in a region remote from the front end of the nipple, a baby holds the nipple deeply in his mouth and presses the partition diaphragm by his tongue tip while moving the jaws for mastication, whereby the milk sucking hole is opened. This enables the baby, when bottle-fed, to learn a sucking technique similar to that involved in breast-feeding.

According to the invention, a baby, when bottle-fed, performs an operation for applying a sucking force by holding the nipple deeply in his mouth, moving his upper and lower jaws for mastication and using his tongue tip to squeeze the front end portion of the nipple from the remote region to the front end portion, that is, an operation which approximates to that involved in breast-feeding, a fact which ensures smooth shift to breast-feeding and is supposed to contribute to sound development of the cerebrum. Further, as it is only necessary to provide a partition diaphragm in a region remote from the front end of the nipple, the nipple is simple in construction and easy to manufacture and also to wash; sticking milk residue or clogging can be easily removed by washing and there is no obstacle to sterilization by boiling.

BRIEF DESCRIPTION OF THE DRAWINGS

FIG. 1 shows in vertical cross-section a nursing bottle and nipple according to a first embodiment of the invention.

FIGS. 1*a*–1*c* show a cross-sectional view taken along lines 1–1 in FIG. 1 illustrating alternative variants for the sucking hole 12 shown in FIG. 1.

FIG. 2 shows in greater detail the partition 11 of the nipple illustrated in FIG. 1.

FIG. 3 shows a nipple according to a second embodiment of the present invention.

FIG. 4 shows in greater detail the partition $\mathbf{11}_1$ of the nipple illustrated in FIG. 3.

FIG. 5 shows a nipple according to a third embodiment of the present invention.

FIG. 6 shows a nipple according to a fourth embodiment of the present invention.

DETAILED DESCRIPTION OF THE PREFERRED EMBODIMENTS

First, referring to FIG. 1 showing an embodiment of the invention, a nursing bottle 1 comprises a bottle body 2, a nipple 3 and a clamping ring 4.

A nursing bottle and nipple according to a first embodiment of the invention shall now be described in reference to FIG. 1.

The bottle body 2 is made from a transparent plastic material and is substantially cylindrical. The bottle body 2 is completely closed except for its upper opening 5, which is cylindrical, having a somewhat reduced diameter. The opening 5 has a male thread 6 cut around the outer periphery thereof. The lateral wall of the bottle body 2 is marked with graduations (not shown) for measuring the amount of milk sucked by a baby.

The nipple 3 is made from a transparent, soft and elastic material (natural rubber, plastic or the like) which is harmless to babies and sterilizable by boiling. The nipple 3 is sized to fit the mouth of a baby and comprises a substantially oval front end portion 7, an inverted funnel-shaped intermediate portion 8 and a bottle mouth fitting portion 9, these portions being integrally molded.

The front end portion 7 of the nipple is of substantially uniform wall thickness and has an opening 10 of small diameter. This small diameter opening 10 is shown circular in the illustrated example, but it may be otherwise shaped and the opening may be replaced by a cut similar to one found in a conventional nipple, such as an I-shaped single cut, an X-shaped cross cut, or Y-shaped triple cut.

The innermost region of the front end portion 7 of the nipple has a partition diaphragm 11 either integrally formed therein or later attached thereto. The partition diaphragm 11 is formed in such a manner as to partition the interior of the nipple 3 and has one or a plurality of milk sucking holes 12 formed in a portion thereof, for example, in the central region or peripheral region thereof. However, the drawings show an instance in which only one milk sucking hole 12 is formed in the central region of the partition diaphragm 11.

As for the position where the partition diaphragm 11 is formed, the partition diaphragm is desirably located in the vicinity of the region corresponding to the areola of the mother's breast; to indicate it in terms of its position in the nipple 3, it is preferably located in the vicinity of the boundary between the front end portion 7 of the nipple and the inverted funnel-shaped intermediate portion 8. However, it may be located somewhat deviated to the front end portion 7 of the nipple or to the inverted funnel-shaped intermediate portion 8. The partition diaphragm 11 may be a flat diaphragm which is parallel to a plane orthogonal to the center line of the nipple 3, as shown in FIG. 1; alternatively, it may be a spherical surface convexed toward the front (FIGS. 3 and 4) or a concaved spherical surface. The thickness of the partition diaphragm 11 is such that it can be deformed by the ordinary masticating force exerted by the upper and lower jaws of a baby. In the illustrated example, the milk sucking hole 12 formed in the partition diaphragm 11 is a cut, said cut being an I-shaped single cut, X-shaped cross cut, or Y-shaped triple cut, as illustrated respectively in FIGS. 1*a*. 1*b* and 1*c*. In addition, the milk sucking hole or holes 12 may be a small hole or holes besides a cut or cuts. In the case where the milk sucking hole 12 is a cut, the portion of the partition diaphragm 12 where the milk sucking hole 12 is formed is preferably made thinner than the other portion thereof; for example, as shown in FIG. 2, a spherical recess 13 is provided and a milk sucking hole 12 in the form of a cut is formed therein. In this case, the region of change in wall thickness between the central portion and the periphery serves as a fulcrum for the opening and closing movement of the cut-like hole edge, thus ensuring a smooth opening and closing movement and making it possible to provide the function of a check valve.

The inverted funnel-shaped intermediate portion 8 extends from the base of the front end portion 7 of the nipple and connects to the bottle mouth fitting portion 9. The bottle mouth fitting portion 9 is formed with a flange 14 adapted to fit the bottle body opening 5 and to receive a pressing force from the clamping ring 4 to tightly close the nursing bottle 1. The outermost peripheral region of the flange 14 is provided with a tapered portion 15 serving to complete the tight contact between the nipple 3 and the bottle body 2. Further, an annular ridge 16 serving to ensure engagement between the clamping ring 4 and the nipple 3 is formed in the boundary between the inverted funnel-shaped intermediate portion 8 and the bottle mouth fitting portion 9. The flange 14 is provided with a single air valve 17 disposed inwardly of the peripheral tapered portion 15 which comes in direct contact with the bottle body opening 5. A plurality of such air valves 17 may be provided. The air valve 17 is of check valve construction comprising a two-step small hole 18 in which the diameter of the outer side is larger than the diameter of the inner side, and a thin diaphragm portion 19 in the form of a cup-shaped projection disposed inwardly of said small hole 18 and formed with a single cut or X-shaped cut in the axial direction of the air valve 17. For protection of the air valve thin diaphragm portion 19, there is provided an annular rib 20 projecting slightly beyond the air valve thin diaphragm portion 19, said rib being disposed on the bottom of the flange and in the inner area of the lower surface of the peripheral tapered portion 15 in contact with the bottle body opening 5.

The clamping ring 4 is made from a plastic material having some elasticity. In order that in the bottle mouth fitting portion 9, the nipple 3 may be removably mounted the bottle body opening 5 its upper lid portion is centrally formed with a circular opening sized to fit the bottle mouth fitting portion 9 and the lateral inner surface of the clamping ring 4 is formed with a female thread adapted to engage a male thread 6 cut in the bottle body opening 5.

The way of using the above embodiment will now be described.

The user turns the clamping ring 4 to loosen the same and removes the clamping ring 4 and nipple 3 from the bottle body 2. Then she puts a suitable amount of milk in the bottle body 2 through the bottle body opening 5. She fits the bottle mouth fitting portion 9 of the nipple in the clamping ring 4. She threadedly engages the female thread of the clamping ring 4 with the male thread 6 of the bottle body opening 5 to force the bottle mouth fitting portion 9 of the nipple 3 into tight contact with the bottle body opening 5, thereby completing the setting. If the nipple 3 of the nursing bottle 1 thus set is merely held in the mouth and the front end portion thereof is sucked at, the milk sucking hole 12 will not open and hence the milk in the bottle body 2 cannot be drunk. That is, the milk sucking hole 12 will not open unless the partition diaphragm 11 located in the innermost region of the front end portion 7 of the nipple is compressively deformed. Therefore, the baby will learn that it is possible to drink milk only by holding the nipple 3 deeply in the mouth, moving the upper and lower jaws for mastication and exerting a sucking force while squeezing the front end portion 7 of the nipple from the innermost region to the front end. Such sucking action approximates to that involved in breast-feeding. The degree of opening of the milk sucking hole 12 and hence the flow rate of milk during said sucking operation are automatically controlled by the sucking force and pressing force exerted by the baby. During this, the air valve 17 is opened and closed to feed air into the bottle body 2, ensuring continuous and smooth feeding of milk to the baby. Since the air valve 17 has the function of a check valve, when the baby stops sucking, it fully closes to prevent milk from flowing out.

Referring to FIGS. 3 and 4 showing another embodiment, the partition diaphragm $11_1$ has a spherical surface slightly convexed above a plane orthogonal to the center line of the nipple 3, i.e., an upwardly arcuate surface. The central portion 11′ of the partition diaphragm $11_1$ is thicker than the peripheral portion, and a dome-shaped recess 13 is formed in the lower side thereof, thereby providing a difference in wall thickness. Above the recess 13, the thin diaphragm portion 11″ is centrally formed with a sucking hole 12 in the form of a cross cut. With this arrangement, the region of change in wall thickness between the central portion and the peripheral portion serves as a fulcrum for the opening and closing movement of the cut-like hole edge, thereby making it possible to effect a smooth opening and closing movement and to provide a check valve function. The milk sucking hole will open when the upwardly arcuate thin diaphragm portion is pressed and will close when it is released from the pressure. Since this upwardly arcuate partition diaphragm portion is located in a region remote from the front end of the nipple, the milk sucking hole, i.e., the cross cut in the thin diaphragm is opened by a baby holding the nipple deeply in his mouth and pressing the partition diaphragm by his tongue tip while moving his upper and lower jaws for mastication and it is closed when he stops pressing.

Referring to FIG. 5, there is shown an embodiment wherein in the innermost region of the front end portion 7 of the nipple, an inner wall 11*a* depends integrally from a small diameter opening 10 and a partition diaphragm $\mathbf{11}_2$ is integrally formed in the depending end of the inner wall 11*a*. The inner wall 11*a* is formed in such a manner that the partition diaphragm $\mathbf{11}_2$ will not be turned inside out to project beyond the small diameter opening 10 by the sucking force exerted by the a baby. The partition diaphragm $\mathbf{11}_2$ may be a flat diaphragm which is parallel to a plane orthogonal to the center line of the nipple 3, as shown in FIG. 5; alternatively, it may be a spherical surface convexed toward the front side, as in FIG. 3, or a concaved spherical surface.

What is shown in FIG. 6 is another embodiment wherein a frusto-conical inner wall 11*b* extends upward from the inner surface of the bottle mouth fitting portion 9 and a partition diaphragm $\mathbf{11}_3$ is provided on the end of the extension.

What is claimed is:

1. A nipple for nursing bottles, comprising:

a nipple body having a pair of openings provided at front and bottom ends thereof and including an inverted funnel-shaped intermediate portion;

an annular flange provided at the bottom end of said nipple body, said annular flange extending outwardly along a direction at a right angle with respect to a longitudinal axis of said nipple body and having an annular rib at a bottom surface thereof;

at least one air valve provided at said annular flange, said air valve having a recessed portion extending from said annular flange into said annular rib and a slit provided at said annular rib for communicating an inside of said nipple to an outside thereof;

a partition diaphragm provided inside of said nipple body and disposed in a region remote from said front and bottom ends of the nipple body in a vicinity of a boundary between said front end and said inverted funnel-shaped intermediate portion and at a position where pressure is exerted by an infant during feeding; and a cut in said partition diaphragm forming a milk sucking passage therein, said cut being normally closed, and wherein said partition diaphragm has a spherical recess at said milk sucking passage, wherein said cut is opened and closed in response to said pressure exerted by an infant during feeding, and wherein the partition diaphragm is upwardly arcuate, and a central portion of said upwardly arcuate partition diaphragm comprises a thickened portion, the lower side of said thickened portion being formed with said spherical recess defining a thin diaphragm portion above said spherical recess, said cut being formed in a central region of said thin diaphragm portion.

2. A nipple for nursing bottles as set forth in claim 1, including an inner wall depending from the front end of the nipple, wherein said partition diaphragm is positioned at an end of said inner wall opposite said front end of the nipple.

3. A nipple for nursing bottles as set forth in claim 1, including a frusto-conical inner wall extending upwardly from the bottom end of the nipple body, wherein said partition diaphragm is positioned at an end of said inner wall opposite the bottom end of the nipple body.

4. A nipple for nursing bottles according to claim 1, wherein said cut and said air valve are opened and closed in response to a sucking action.

5. A nipple for nursing bottles according to claim 1, wherein said cut comprises an X-shaped cross cut.

6. A nipple for nursing bottles according to claim 1, wherein said cut comprises a Y-shaped triple cut.

7. A nipple for nursing bottles according to claim 1, wherein said cut comprises an I-shaped single cut.

* * * * *